US008336789B2

(12) United States Patent
Kuo

(10) Patent No.: US 8,336,789 B2
(45) Date of Patent: Dec. 25, 2012

(54) STRUCTURE OF SPRAYING DEVICE

(75) Inventor: Chao-Ming Kuo, Keelung (TW)

(73) Assignee: Grain Point Enterprise Limited, Keelung (TW)

( * ) Notice: Subject to any disclaimer, the term of this patent is extended or adjusted under 35 U.S.C. 154(b) by 331 days.

(21) Appl. No.: 12/862,736

(22) Filed: Aug. 24, 2010

(65) Prior Publication Data

US 2010/0320289 A1 Dec. 23, 2010

(30) Foreign Application Priority Data

Mar. 11, 2009 (TW) ..... 98220272 U

(51) Int. Cl.
*B05B 3/00* (2006.01)

(52) U.S. Cl. ..... 239/226; 239/310; 239/318; 239/526; 239/237; 239/315; 239/288; 239/418

(58) Field of Classification Search ..... 239/310, 239/318, 525, 526, 237, 263, 302, 315, 226, 239/225.1, 288, 104, 418
See application file for complete search history.

(56) References Cited

U.S. PATENT DOCUMENTS 4,969,603 A * 11/1990 Norman ..... 239/318
5,954,240 A * 9/1999 Duchon et al. ..... 222/484
6,883,732 B2 * 4/2005 Hasegawa ..... 239/416.5
7,086,610 B2 * 8/2006 Hubmann et al. ..... 239/310
7,513,442 B2 * 4/2009 Dodd ..... 239/310
7,661,604 B1 * 2/2010 MacLean-Blevins ..... 239/10
7,823,584 B2 * 11/2010 Geser et al. ..... 128/200.17
8,056,830 B1 * 11/2011 Pedersen ..... 239/222.13
2005/0161530 A1 * 7/2005 Bartsch et al. ..... 239/310
2006/0097073 A1 * 5/2006 Dodd ..... 239/310
2007/0102540 A1 * 5/2007 MacLean-Blevins ..... 239/310
2009/0057443 A1 * 3/2009 Sendo ..... 239/405

* cited by examiner

*Primary Examiner* — Dinh Q Nguyen
*Assistant Examiner* — Trevor E McGraw
(74) *Attorney, Agent, or Firm* — Leong C. Lei

(57) ABSTRACT

A spraying device includes a control handle, a first hollow barrel, a second hollow barrel, a driving unit, a spraying tube, and a liquid ejection tube. With the driving unit that is driven by high pressure air to rotate received inside the second hollow barrel, when the control handle is operated to supply high pressure air to drive the driving unit to rotate in high speed, the spraying tube is caused to rotate with a high speed, making high pressure rotating air ejected from the spraying tube inducing repeated and rotating impacts on a surface to be cleaned to thereby improve the effect of dust removal. Further, the liquid ejection tube is located within the spraying tube and ejects a stream of water (or cleaning agent), which is mixed with the high pressure air to generate a high speed rotating impact to also realize surface rinsing of an object.

8 Claims, 7 Drawing Sheets

STRUCTURE OF SPRAYING DEVICE

(a) TECHNICAL FIELD OF THE INVENTION

The present invention generally relates to a structure of spraying device, and more particularly to a spraying device that generates high speed rotating air streams to cause a water stream ejected from the spraying device to mix with the high pressure rotating air streams to generate high speed rotating impacting forces for effectively improving the effect of dust removal and also featuring rinsing the surface of an object.

(b) DESCRIPTION OF THE PRIOR ART

A conventional cleaning device is often a manually-operated spraying device, which applies air pressure in such a way that when an operation bar is pushed/pulled, water is drawn into a spraying tube and then ejected from the spraying tube through the application of a driving force. This type of known spraying device allows only for single ejection of water and operation of the device through multiple times of pushing/pulling is effort-consuming and may be troublesome for the general consumers.

To overcome such a problem, a water spraying device that allows water to be sprayed through both pushing and pulling operations. An example is shown in Taiwan Patent Publication No. 88275, which discloses a structure composed of an outer tube, which is of a hollow tubular body having a front end opening forming therein internal threading, a cap being attached to the front end and forming a threaded hole in communication with the outer tube, the tubular body of the outer tube having an end forming external threading; a central tube, which has a front end forming an opening and a rear end that is closed, a push disk, an O-ring, a notched plate, and a piston being sequentially mounted to the front end of the tube, the tube forming two symmetrically arranged water ingresses; and a minor tube, which is tightly coupled to a rear center of a spraying head, the spraying head comprising a screw bar, the minor tube being arranged inside the outer tube with a rear end extending into the front end opening, the minor tube having an outside diameter substantially corresponding to an inside diameter of the central tube. With such an arrangement, water spraying can be realized through frontward pushing and rearward pulling of the central tube.

Although such a known structure can perform water spraying with frontward pushing and rearward pulling of the central tube, yet such a structure is of small water storage, so that in a practical application, the water sprayed can cover only a limited range with a limited amount of water. This leads to a drawback that a user must frequently replenish water. Further, since the spraying of water is realized through manually pushing and pulling the central tube, the repeated and frequent pushing and pulling may cause troubles to the user.

SUMMARY OF THE INVENTION

The primary objective of the present invention is to provide a structure of spraying device, which comprises a control handle, a first hollow barrel, a second hollow barrel, a driving unit, a spraying tube, and a liquid ejection tube. With the driving unit that is driven by high pressure air to rotate received inside the second hollow barrel, when the control handle is operated to supply high pressure air to drive the driving unit to rotate in high speed, the spraying tube is simultaneously caused to rotate with a high speed, making high pressure rotating air ejected from the spraying tube inducing repeated and rotating impacts on a surface to be cleaned to thereby improve the effect of dust removal and cleaning. Further, the liquid ejection tube is located within the spraying tube and ejects a stream of water (or cleaning agent), which is mixed with the high pressure air to generate a high speed rotating impact to also realize surface rinsing of an object.

Another objective of the present invention is to provide a structure of spraying device, wherein the first hollow barrel is coupled to a liquid storage container, which comprises a vessel that forms, in an outside surface thereof, at least one recess, which allows a user to tightly hold the vessel with the recess even though the hand is wet and slipping in order to effectively open/close the cap.

A further objective of the present invention is to provide a structure of spraying device, wherein the liquid storage container can receive therein rustproof oil, chemical agents or other solvent, whereby with the spraying tube of the sprayer ejecting air in a rotating fashion, the rustproof oil or chemical agent or other solvent can be atomized to form extremely tiny droplets for spraying on a large area of an object to thereby realize the efficacies of spraying and coating.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
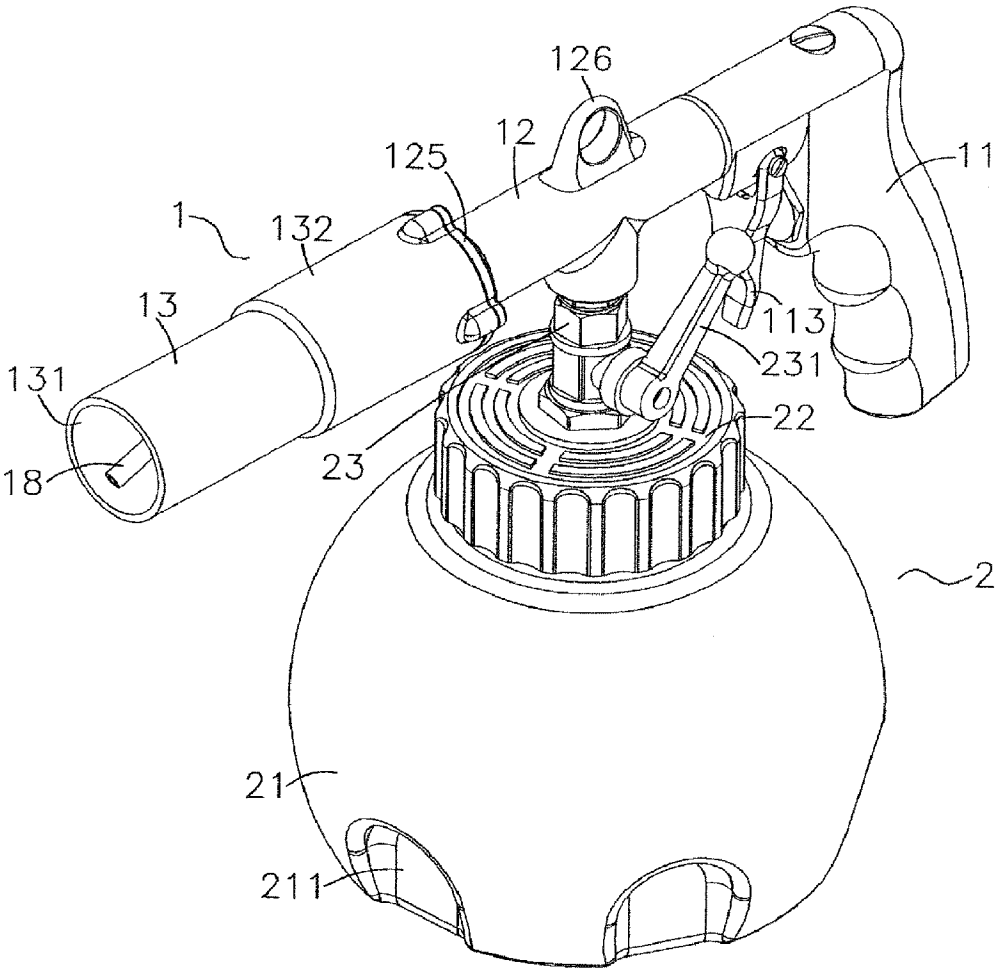
FIG. 1 is a perspective view showing a spraying device according to the present invention.
Figure 2:
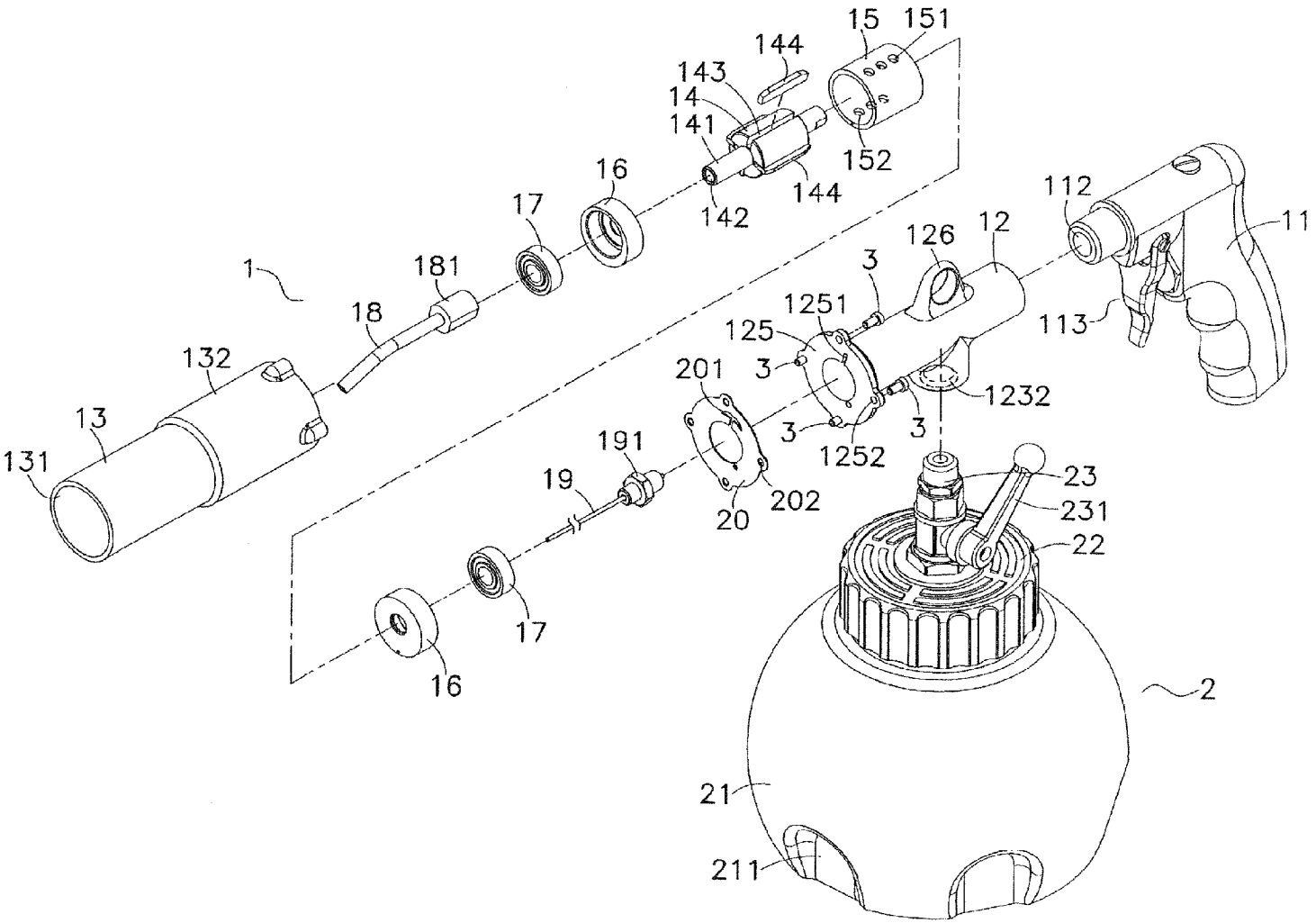
FIG. 2 is an exploded view of the spraying device of the present invention.
Figure 3:
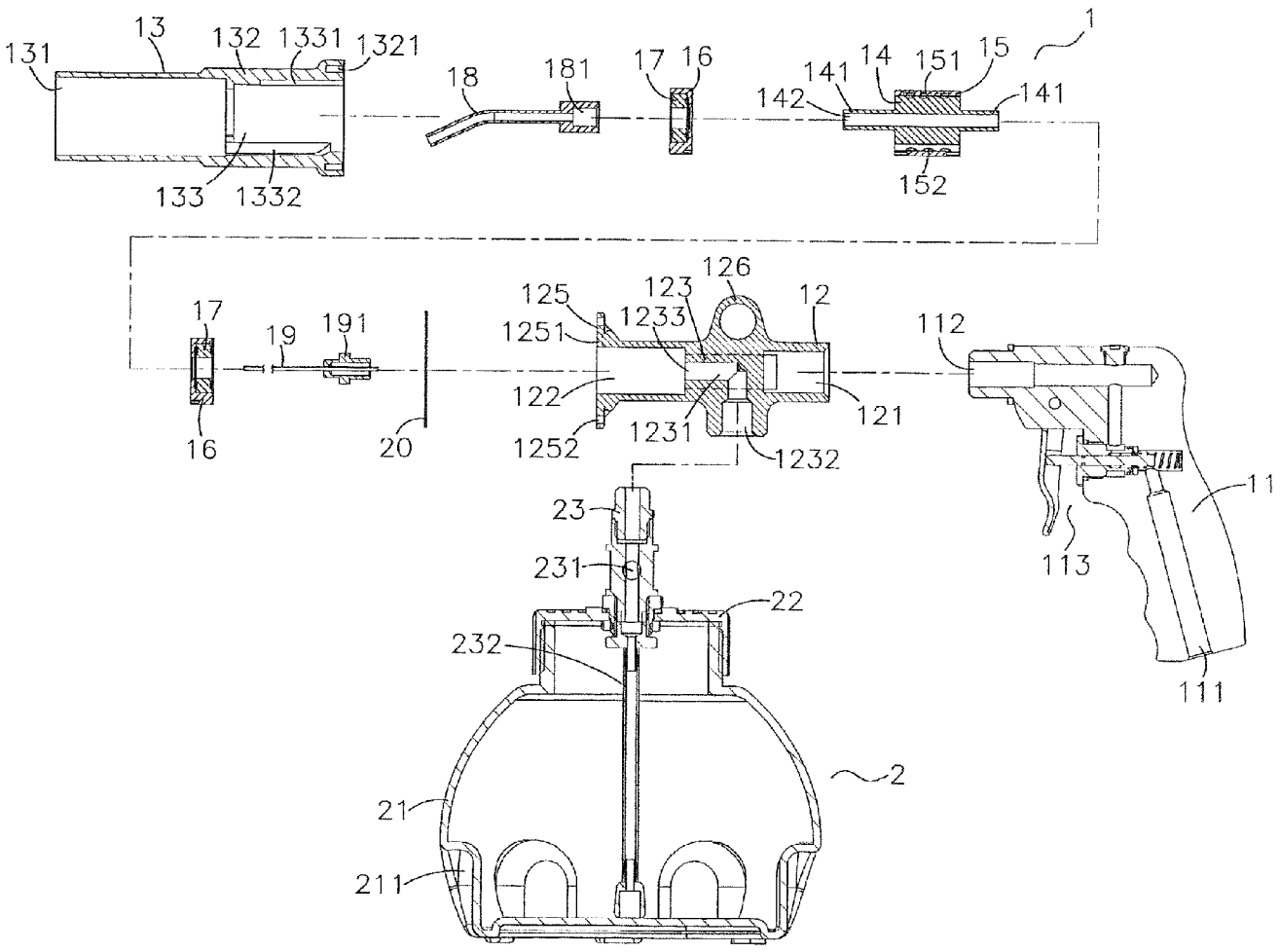
FIG. 3 is an exploded view, in sectioned form, of the spraying device of the present invention.
Figure 6:
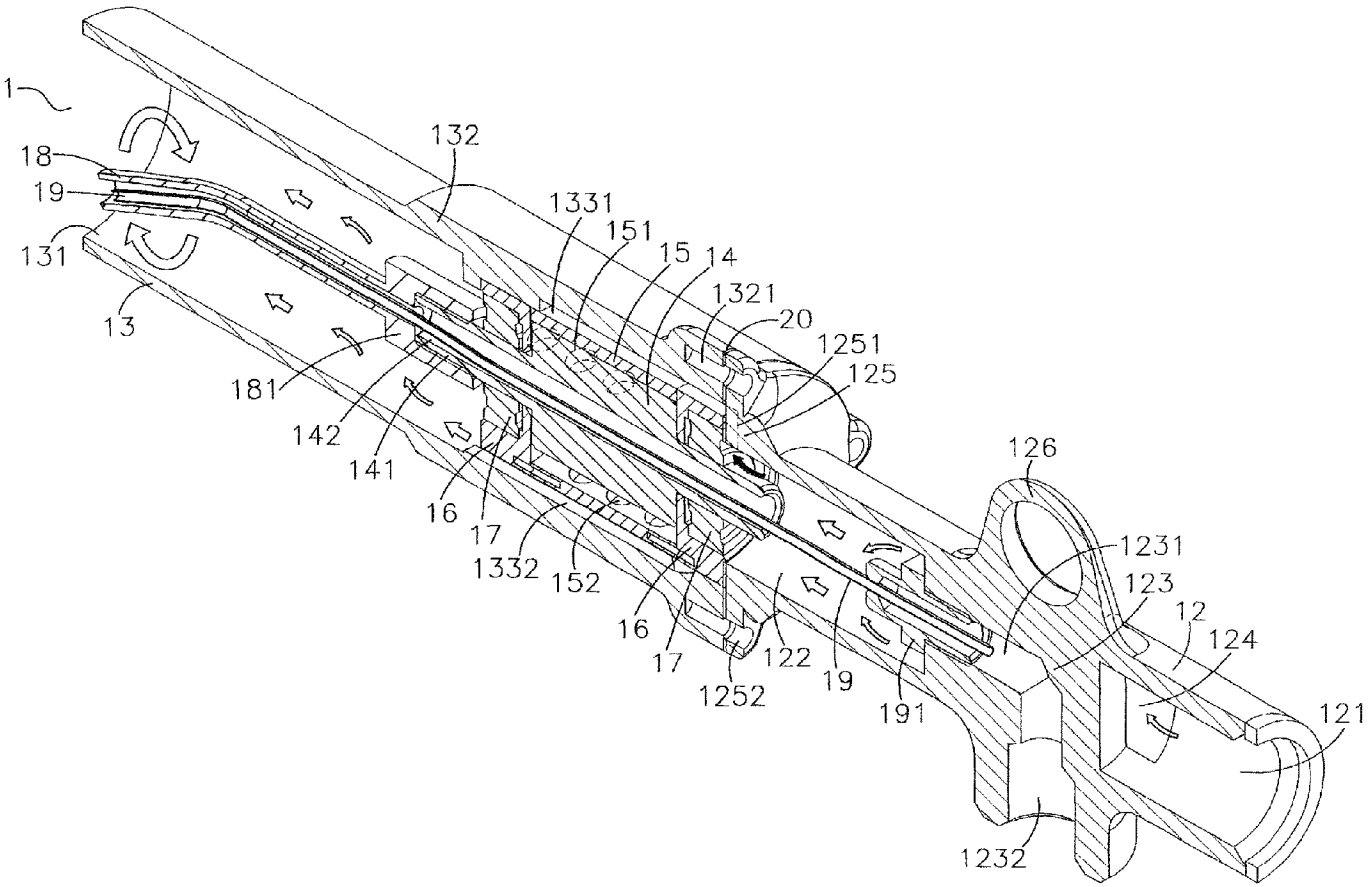
FIG. 6 is a perspective view, in sectioned form, of a portion of the spraying device of the present invention.

Referring to FIGS. 1, 2, 3, and 6, the present invention provides a spraying device, which comprises a sprayer 1 and one or a plurality of liquid storage containers 2. The sprayer 1 comprises a control handle 11, a first hollow barrel 12, a second hollow barrel 13, a driving unit 14, a spraying tube 18, and a liquid ejection tube 19.

The control handle 11 forms one or a plurality of air inlet openings 111 for connection with an external air supply device and one or a plurality of air outlet openings 112. The air inlet opening 111 and the air outlet opening 112 are in communication with each other and a manually-operated depressible air valve 113 is arranged on a passage connecting between the air inlet opening 111 and the air outlet opening 112.

The first hollow barrel 12 has an end forming a first coupling end 121, which is connected to the air outlet opening 112 of the control handle 11 and an opposite end forming a second coupling end 122. The first hollow barrel 12 receives and retains therein a block 123, which forms an internal passage 1231, located between the first coupling end 121 and the second coupling end 122. The block 123 has an outside surface forming one or a plurality of air passageways 124 communicating between the first coupling end 121 and the second coupling end 122. The internal passage 1231 of the block 123 has an end forming a first end port 1232 that faces outward of the first hollow barrel 12 and another end of the passage 1231 opposes the second coupling end 122 and forms a second end port 1233. The first end port 1232 and the first coupling end 121 are arranged to have the openings thereof facing different directions. Further, the first hollow barrel 12 comprises a coupling portion 125 that extends outward from the opening of the second coupling end 122. The coupling portion 125 has a surface forming one or a plurality of grooves 1251 in communication with the second coupling end 122. The coupling portion 125 forms one or a plurality of bolt holes 1252. The first hollow barrel 12 forms on an outside surface thereof one or a plurality of hooking rings 126.

The second hollow barrel 13 has an end that is an open end 131 and an opposite end forming a coupling end 132 coupled to the coupling portion 125 of the first hollow barrel 12. The coupling end 132 forms one or a plurality of fastening holes 1321 respectively corresponding to the bolt holes 1252 of the first hollow barrel 12. Further, the second hollow barrel 13 forms therein an accommodation chamber 133, and also forms a first channel 1331 in an upper wall of the accommodation chamber 133 and a second channel 1332 in a lower wall of the accommodation chamber 133.

The driving unit 14 is received in the accommodation chamber 133 of the second hollow barrel 13. The driving unit 14 has two ends which extend outward to form a shaft 141. Formed through the shaft 141 is a bore 142 that extends through the driving unit 14. The driving unit 14 forms one or a plurality of slots 143, and the slots 143 respectively and movably receive therein blades 144. The driving unit 14 receives a sleeve 15 fit outside the driving unit. The sleeve 15 forms one or a plurality of first air apertures 151 and second air apertures 152. The first air apertures 151 correspond in position to the first channel 1331 of the second hollow barrel 13 and the second air apertures 152 correspond in position to the second channel 1332 of the second hollow barrel 13. The sleeve 15 has a bore having an inside diameter greater than the driving unit 14 for receiving the driving unit therein. The driving unit 14 also receives positioning seats 16, which are hollow, fit over opposite portions of the shaft 141 and tightly positioned against the sleeve 15. Each positioning seat 16 receives and retains therein one or a plurality of bearings 17 through which the shaft 141 extends and is thus supported.

The spraying tube 18 has an end that is curved and an opposite end forming a fitting portion 181 coupled to the shaft 141 of the driving unit 14.

The liquid ejection tube 19 has an end extending through and received in the bore 142 of the driving unit 14 and the spraying tube 18 and an opposite end forming a retention seat 191 coupled to the second end port 1233 inside the first hollow barrel 12.

The liquid storage container 2 comprises a vessel 21, and the vessel 21 has an outside surface forming one or a plurality of recesses 211. The vessel 21 has an open mouth to which a cap 22 is mounted. The cap 22 forms a jointing tube 23 coupled to the first end port 1232 of the first hollow barrel 12. The jointing tube 23 comprises a control valve 231, which controls the flow of liquid, mounted thereto and also comprises a liquid drawing tube 232.

Figure 4:
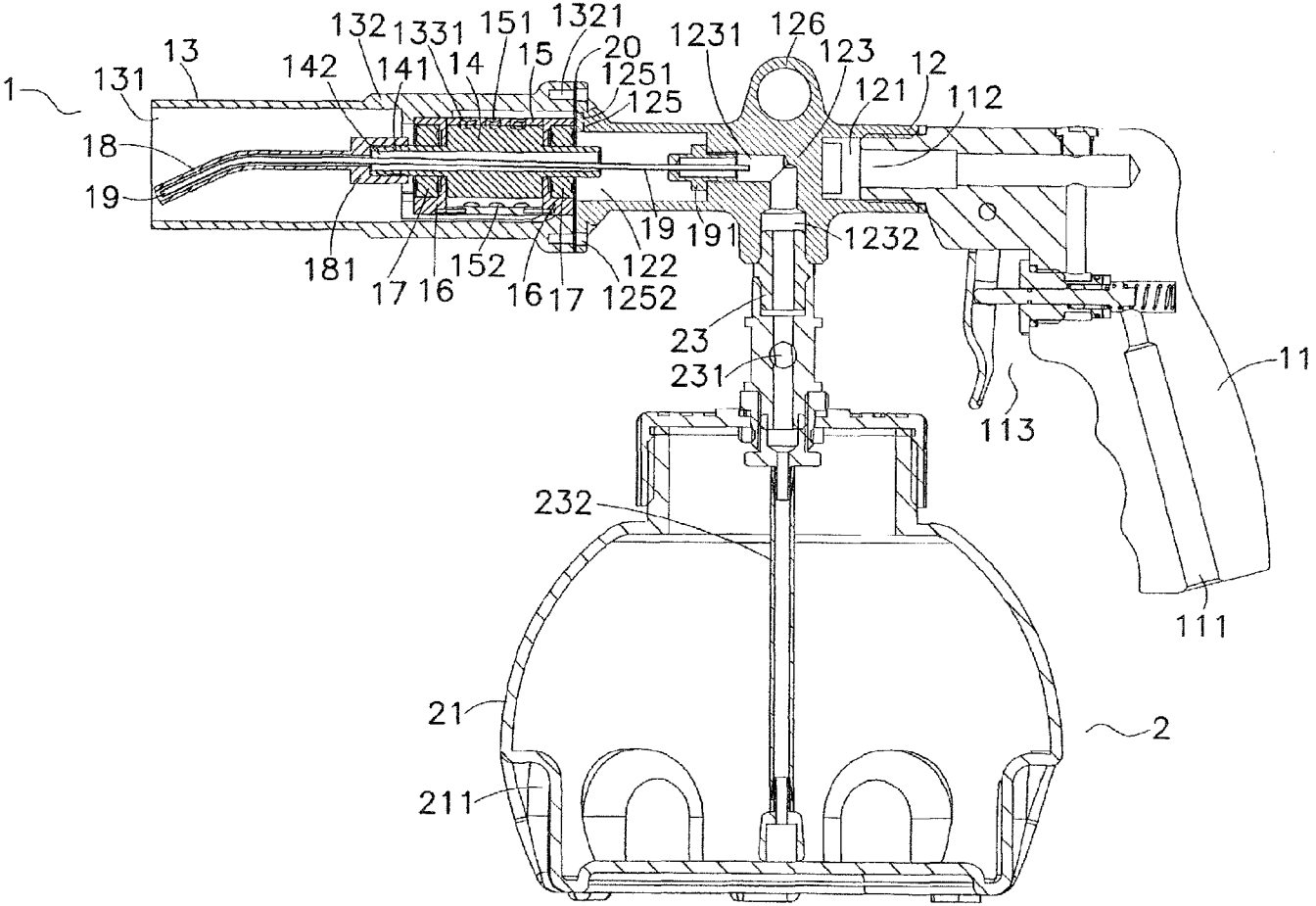
FIG. 4 is a cross-sectional view of the spraying device of the present invention in an assembled form.

Referring to FIGS. 1, 2, 3, 4, and 6, to assemble the spraying device of the present invention, the first coupling end 121 of the first hollow barrel 12 is connected to the air outlet opening 112 of the control handle 11. The second end port 1233 inside the first hollow barrel 12 receives the retention seat 191 of the liquid ejection tube 19 to fit therein, so as to fix the liquid ejection tube 19 inside the first hollow barrel 12. The accommodation chamber 133 of the second hollow barrel 13 receives the driving unit 14, the sleeve 15, the positioning seats 16, and the bearings 17 to be sequentially set therein, whereby with such an arrangement of the sleeve 15 fit outside the driving unit 14 and the positioning seats 16 fit over the opposite portions of the shaft 141 and positioned tightly against the sleeve 15, the driving unit 14 is tightly enclosed by the sleeve 15 and the two positioning seats 16. With the arrangement of one of a plurality of bearings 17 received in the two positioning seats 16 for receiving the opposite portions of the shaft 141 to extend therethrough, the driving unit 14 is allowed to undergo rotation. Further, the coupling end 132 of the second hollow barrel 13 is coupled to the coupling portion 125 of the first hollow barrel 12. The free end of the liquid ejection tube 19 is received through the bore 142 of the driving unit 14 and located in the spraying tube 18. This completes the assembling of the sprayer 1.

Further, the coupling portion 125 of the first hollow barrel 12 and the coupling end 132 of the second hollow barrel 13 may further receive one or a plurality of gaskets 20 interposed therebetween for more tightly coupling the first hollow barrel 12 and the second hollow barrel 13 together. Further, the bolt holes 1252 of the first hollow barrel 12 are set to correspond to the fastening holes 1321 of the second hollow barrel 13 to allow fasteners 3 (such as bolts and rivets) to sequentially extend through the bolt holes 1252 and the fastening holes 1321 for securing the first hollow barrel 12 and the second hollow barrel 13 together. The first coupling end 121 of the first hollow barrel 12 is coupled to the air outlet opening 112 of the control handle 11 through for example bolting or force fitting. The retention seat 191 of the liquid ejection tube 19 is coupled to the second end port 1233 inside the first hollow barrel 12 through for example bolting or force fitting.

Further, the jointing tube 23 of the liquid storage container 2 is coupled to the first end port 1232 of the first hollow barrel 12 through for example bolting or force fitting to joint the sprayer 1 to the liquid storage container 2.

Figure 5:
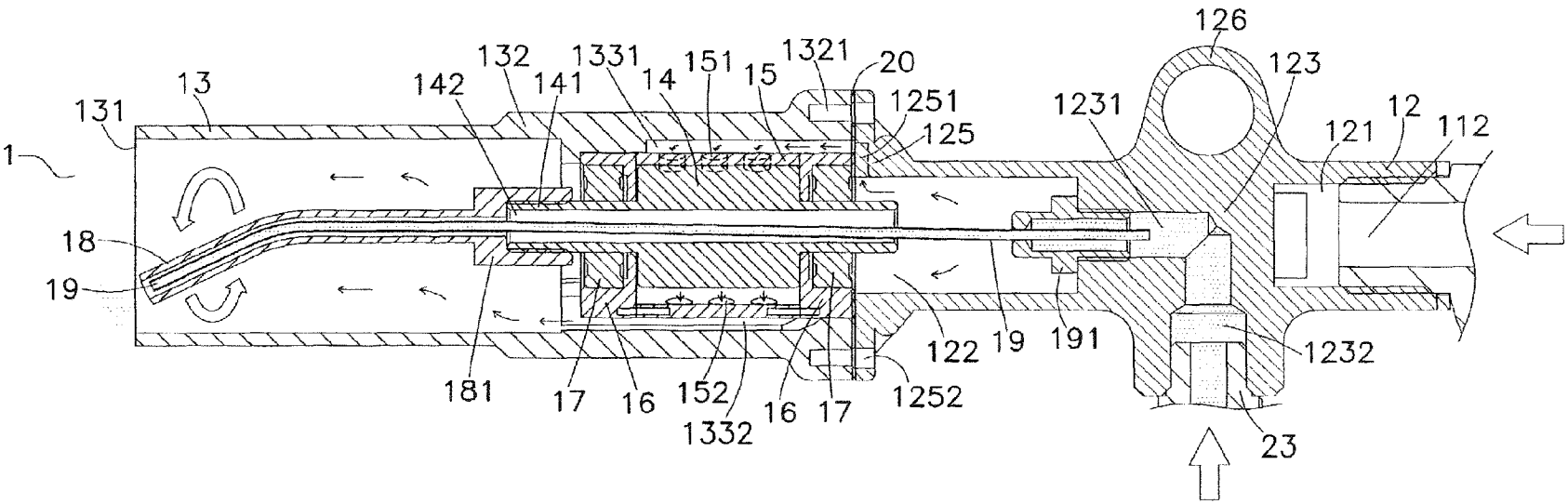
FIG. 5 is a cross-sectional view of a portion of the spraying device of the present invention.
Figure 7:
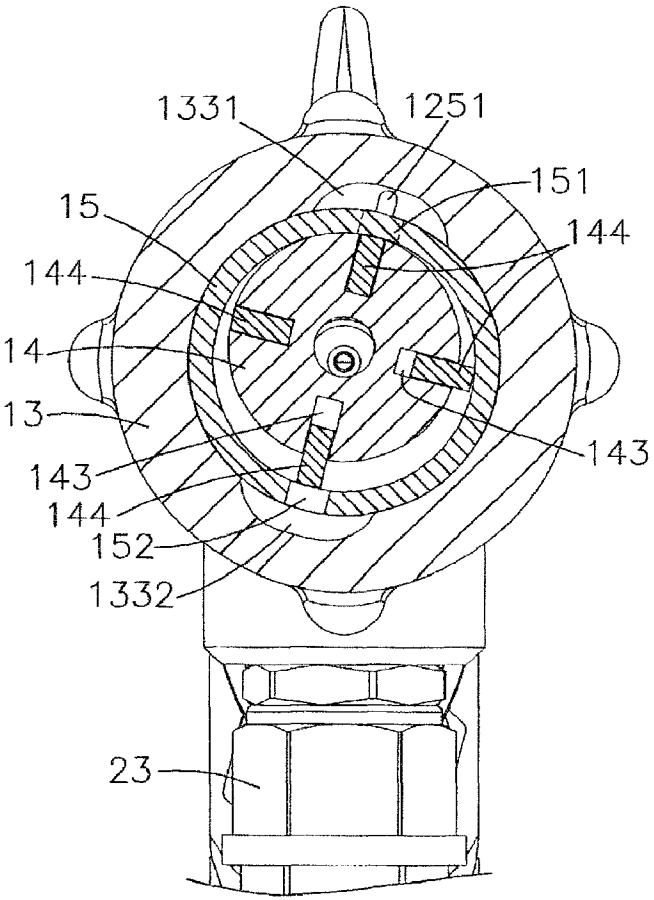
FIG. 7 is a front view of the spraying device of the present invention.

Referring to FIGS. 1-7, to practice the spraying device according to the present invention, the air inlet opening 111 of the control handle 11 is connected to an external air supply device (not shown), and the depressible air valve 113 is operated to control air flowing toward the air outlet opening 112 for being supplied to the first hollow barrel 12. Upon entering the first hollow barrel 12, air flows through the air passageway 124 formed inside the first coupling end 121 into the second coupling end 122, so that the air flow is separated from the passage 1231. The air is then supplied from the second coupling end 122 to the second hollow barrel 13. Upon entering the second hollow barrel 13, a fraction of the air is conducted through the bore 142 of the driving unit 14 for expulsion through the spraying tube 18 and the remaining air is conducted by the grooves 1251 of the first hollow barrel 12 to flow into the first channel 1331 of the second hollow barrel 13 and outside the sleeve 15. The air then passes through the first air apertures 151 of the sleeve 15 into the inside of the sleeve 15. At this time, the blades 144 arranged in the slots 143 of the driving unit 14 serve as a baffle providing a resistance against the flow of the air, so that the air, when moving inside the sleeve 15, is forced to drive the driving unit 14 to rotate inside the sleeve 15. Since the inside diameter of the sleeve 15 is greater than the driving unit 14, and since the driving unit 14 is set at an eccentric position with respect to a center of the sleeve 15, when one of the blades 144 within the slots 143 is located at the lower portion or bottom of the sleeve 15, the blade 144 partially slides off the slot 143, forming a resistance against the air flow, thereby driving the driving unit 14 to rotate; and when one of the blades 144 within the slots 143 is located at the upper portion or top of the sleeve 15, the blade 144 retracts back into the slot 143. In this way, the blades 144 repeatedly slide out of and into the slots 143, and the air inside the sleeve 15 is caused to flow through the second air apertures 152 into the second channel 1332 of the second hollow barrel 13 for discharging outwards through the open end 131 of the second hollow barrel 13.

When the driving unit 14 of the sprayer 1 according to the present invention is driven by the air flow to rotate, the spraying tube 18 that is coupled to the driving unit 14 is also force to rotate in unison. When air is supplied from the second coupling end 122 to the second hollow barrel 13, since the bore 142 of the driving unit 14 is smaller in diameter than the second coupling end 122, air is subjected to compression to generate high speed and high pressure, whereby when the air reaches the spraying tube 18, Venturi effect is induced, which effect helps drawing the liquid contained in the liquid storage container 2 through the liquid drawing tube 232, the jointing tube 23, and the liquid ejection tube 19 for ejection outward. Thus, with the driving unit 14 driving high speed rotation of the spraying tube 18, the spraying tube 18 sprays high-pressure air in a rotating fashion for inducing repeated and rotating impacts on a surface to be cleaned thereby improving the result of dust removal and cleaning operation. Further, the liquid ejection tube 19 contained inside the spraying tube 18 ejects a stream of for example water (or cleaning agent), which is mixed with the high pressure air to generate a high speed rotating impact to also realize surface rinsing of an object.

Further, the vessel 21 of the liquid storage container 2 according to the present invention forms, in an outside surface thereof, at least one recess 211, which allows a user to tightly hold the vessel 21 even though the hand is wet and slipping in order to effectively open/close the cap 22. Further, the liquid storage container 2 can alternatively receive therein solvent or solution, such as rustproof oil or chemical agents, whereby with the spraying tube 18 of the sprayer 1 ejecting air in a rotating fashion, the rustproof oil or chemical agent or other solvent can be atomized to form extremely tiny droplets for spraying on a large area of an object to thereby realize the efficacies of spraying and coating.

Thus, the feature of the present invention is that the sprayer 1 receives therein a driving unit 14 that is operated with air flows, so that when compressed air supplied through the control handle 11 drives high speed rotation of the driving unit 14, the spraying tube 18 is simultaneously caused to rotate with a high speed, making high pressure rotating air ejected from the spraying tube 18 inducing repeated and rotating impacts on a surface to be cleaned to thereby improve the effect of dust removal and cleaning. Further, the liquid ejection tube 19 located within the spraying tube 18 also ejects a stream of water (or cleaning agent), which is mixed with the high pressure air to generate a high speed rotating impact to also realize surface rinsing of an object.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A spraying device, which comprises a sprayer comprising:

a control handle, which forms one or a plurality of air inlet openings and one or a plurality of air outlet openings;

a first hollow barrel, which has an end forming a first coupling end connectable with the air outlet opening of the control handle and another end forming a second coupling end, the first hollow barrel receiving and retaining therein a block, which forms an internal passage and is located between the first coupling end and the second coupling end, the block having an outside surface forming one or a plurality of air passageways communicating between the first coupling end and the second coupling end, the internal passage of the block having an end forming a first end port that faces outward of the first hollow barrel and another end of the passage opposing the second coupling end and forming a second end port, a coupling portion extending outward from an opening of the second coupling end and having a surface forming one or a plurality of grooves in communication with the second coupling end;

a second hollow barrel, which has an end that is an open end and an opposite end forming a coupling end connectable to the coupling portion of the first hollow barrel, the second hollow barrel forming therein an accommodation chamber and also forming a first channel in an upper wall of the accommodation chamber and a second channel in a lower wall of the accommodation chamber;

a driving unit, which is received in the accommodation chamber of the second hollow barrel and has two ends which extend outward to form a shaft, a bore formed in the shaft and extending through the driving unit, a sleeve being fit outside the driving unit and forming first air apertures corresponding in position to the first channel of the second hollow barrel and second air apertures corresponding in position to the second channel of the second hollow barrel, positioning seats being respectively fit over opposite end portions of the shaft and tightly positioned against the sleeve, each of the positioning seats receiving and retaining therein a bearing through which the shaft extends and is thus supported;

a spraying tube, which is arranged inside the second hollow barrel and has an end forming a fitting portion connectable with the shaft of the driving unit; and a liquid ejection tube, which has an end extending through and received in the bore of the driving unit and the spraying tube and an opposite end forming a retention seat connectable to the second end port inside the first hollow barrel.

2. The spraying device according to claim 1, wherein the first end port and an opening of the first coupling end are arranged to face different directions.

3. The spraying device according to claim 1, wherein the coupling portion of the first hollow barrel forms one or a plurality of bolt holes.

4. The spraying device according to claim 1, wherein the first hollow barrel forms on an outside surface thereof one or a plurality of hooking rings.

5. The spraying device according to claim 1, wherein the coupling end of the second hollow barrel forms one or a plurality of fastening holes.

6. The spraying device according to claim 1, wherein the driving unit forms one or a plurality of slots, which respectively and movably receive therein blades.

7. The spraying device according to claim 1, wherein the coupling portion of the first hollow barrel and the coupling end of the second hollow barrel receive one or a plurality of gaskets interposed therebetween.

8. The spraying device according to claim 1, wherein the first end port of the first hollow barrel is connectable with a liquid storage container.

* * * * *